United States Patent [19]

Houck

[11] 4,106,222

[45] Aug. 15, 1978

[54] INFLATABLE PODIATRIC DEVICE

[76] Inventor: Randall G. Houck, 721 Unity Dr., Indian Harbor, Fla. 32937

[21] Appl. No.: 820,610

[22] Filed: Aug. 1, 1977

[51] Int. Cl.[2] ..... A43B 3/12; A43B 13/20

[52] U.S. Cl. ..... 36/29; 36/11.5

[58] Field of Search ..... 36/11.5, 28, 29, 35 B

[56] References Cited

U.S. PATENT DOCUMENTS

| | | | |
|---|---|---|---|
| 2,595,643 | 5/1952 | Daugherty | 36/11.5 |
| 3,738,024 | 6/1973 | Matsuda | 36/29 X |
| 4,016,662 | 4/1977 | Thompson | 36/29 |

FOREIGN PATENT DOCUMENTS

| | | | |
|---|---|---|---|
| 1,037,244 | 9/1953 | France | 36/11.5 |
| 1,158,897 | 6/1958 | France | 36/29 |

*Primary Examiner*—Patrick D. Lawson

*Attorney, Agent, or Firm*—Duckworth, Hobby, Allen & Pettis

[57] ABSTRACT

A sole includes an inflatable envelope formed of a flexible material having a first surface adapted to conform to a foot of the wearer. A valve stem extends through the envelope along the first surface for inflating the envelope, the valve extending substantially above the first surface and being positioned such that the valve is engagable between adjacent toes of the wearer.

17 Claims, 4 Drawing Figures

FIG. 1
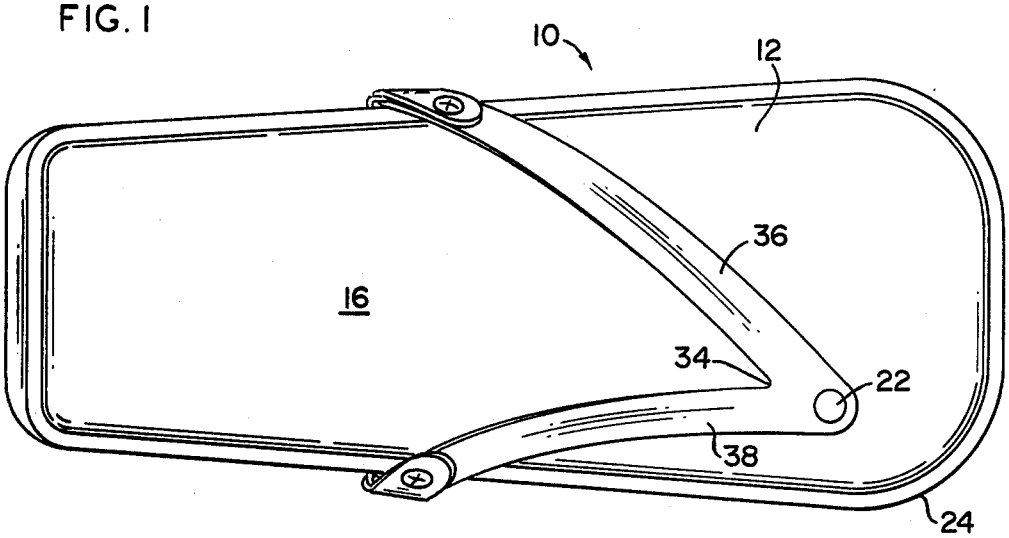
FIG. 2
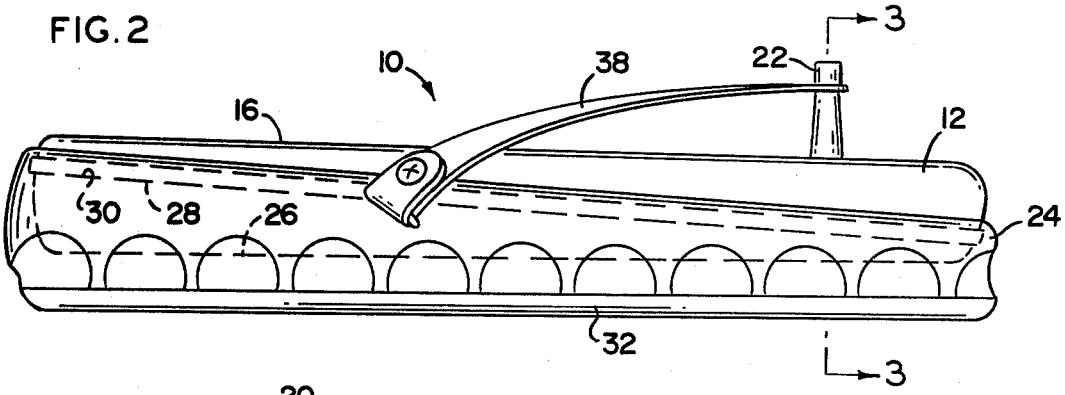
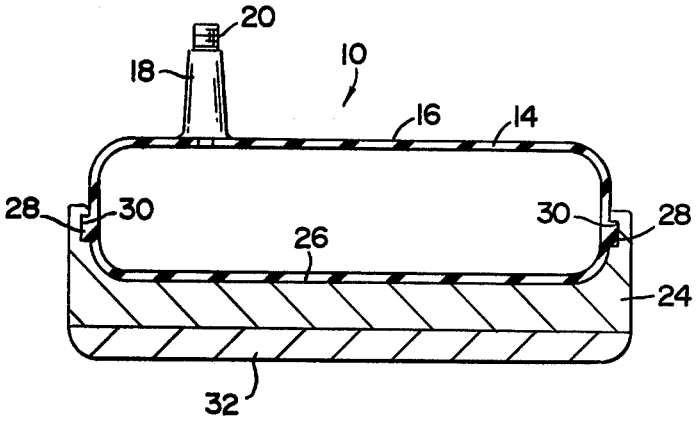
FIG. 3
FIG. 4
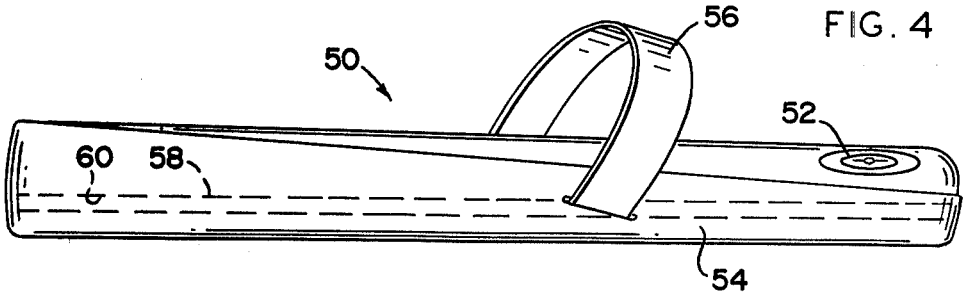

INFLATABLE PODIATRIC DEVICE

BACKGROUND OF THE INVENTION

1. Field of the Invention

The present invention relates to podiatric devices, and in particular relates to devices of this nature which are capable of being inflated.

2. Description of the Prior Art

There are numerous suggestions in the prior art for inflated insteps for shoes and the like.

In U.S. Pat. No. 1,701,260, Fischer discloses a sole pad for shoes, in which the pad is provided with a valve allowing inflation of the envelope forming the pad. A similar arrangement is disclosed by Persichino in the U.S. Pat. No. 2,177,116.

Other prior art of interest includes U.S. Pat. Nos. 2,488,382 to Davis; 2,645,865 to Town; and 3,990,457 to Voorhees.

While the arrangements described above are useful as comfort devices for pre-existing shoe designs, none of these arrangements are capable of adaptation as an inflatable sandal, or other arrangement which may be worn apart from the pre-existing shoe design.

SUMMARY OF THE INVENTION

The present invention contemplates an inflatable podiatric device comprising a sole including an inflatable envelope formed of a flexible material having a first surface adapted to conform to the foot of a wearer. The device includes means extending through the envelope along the first surface for inflating the envelope, wherein the inflating means extends substantially above the first surface and is positioned at a point along that surface so as to be engagable between adjacent toes of the wearer.

In a preferred embodiment of the present invention, the inflating means comprises a valve stem extending substantially above the first surface, and including a closure member for preventing the escape of air from the envelope. In this preferred embodiment, the cap serves as a means for restricting the movement of a strap which is attached to the valve stem and extends to opposite sides of the sole. A further aspect of the preferred embodiment of the present invention contemplates a shell of a material which is relatively inflexible with respect to the envelope, the shell having a capacity for supporting the envelope therein. Either the shell or the envelope is provided with a peripheral bead, the other being provided with a peripheral slot, such that the bead and slot cooperate to fix the envelope in position within the cavity of the shell. The device may be further provided with a relatively rigid material serving as a bottom supporting layer.

DESCRIPTION OF THE DRAWINGS

FIG. 1 is a top view of a podiatric device in accordance with the preferred embodiment of the present invention.

FIG. 2 is a side elevation of the device shown in FIG. 1.

FIG. 3 is a cross-sectioned end view device shown in FIG. 2, taken along the line 3—3.

FIG. 4 is a side elevation of an alternate embodiment of the present invention.

DESCRIPTION OF THE PREFERRED EMBODIMENT

A preferred embodiment of the present invention will now be described with reference to FIGS. 1, 2, and 3.

The inflatable podiatric device, referred to generally as 10, includes an envelope 12 defined by a flexible and inflatable thin wall 14 of a material such as rubber or the like. The envelope 12 is filled with a fluid, such as water or air, which is substantially incompressible. The envelope 12 defines a first surface 16 which is preferably positioned in an upward direction so as to be engaged by the bottom of the foot of the wearer (not shown).

Now noting FIGS. 2 and 3, the device 10 is provided with a valve stem 18 extending from the first surface 16, and being positioned toward one end and to one side of that surface. Valve stem 18 is of a conventional configuration, and communicates between the interior of the envelope 12 and the ambient. The extremity of the valve stem 18 is threaded to receive a closure member 22, again in a conventional manner.

A shell 24 is provided, the shell being of a relatively inflexible material with respect to the material forming the envelope 12. By way of example, the shell 24 may comprise a stiff rubber material. The shell 24 defines a cavity 26 in the upper surface thereof, the cavity extending through a substantial portion of the shell 24.

With specific reference to FIG. 3, the thin wall 14 of the envelope 12 is provided with a peripheral bead 28 along the side of the wall 14. A corresponding peripheral slot 30 is formed in the side wall of the cavity 26 of the shell 24. When properly positioned in the cavity 26, the bead 28 snaps into the slot 30, thus causing the envelope 12 to be fixed to the shell.

The device 10 may also include a rigid layer 32, such as leather, serving as the bottommost portion of the sole.

Referring again to FIGS. 1 and 2, the device 10 is provided with a strap 34 adapted to fit across the top of the foot of the wearer in a conventional manner similar to sandals and the like. The strap 34 includes a first portion 36 extending between a first side of the sole to the valve stem 18, and further includes a second portion extending between the second side of the sole to the valve stem 18. The strap 34 includes a hole between the first and second portions 36, 38, the hole fitting about the valve stem 18 and being covered by the closure member 22. In this way, the closure 22 restricts movement of the strap 34, until such time as the closure is removed from the threaded extremity 20 of the valve stem 18.

A second embodiment of the arrangement of the present invention is shown in FIG. 4.

This embodiment, referred to generally as 50, includes an envelope 51 and a conventional valve 52 which is flush with the surface of the envelope.

The embodiment 50 includes a shell 54 somewhat similar to the shell 24 in FIGS. 2 and 3. The shell 54 includes a slot 60 similar to the slot 30 as shown in FIG. 3, the envelope 51 including a bead 58 essentially identical to the bead 28 in FIG. 3. A strap 56 bridging the two sides of the sole is provided to support the shoe to the bottom of the wearer's foot.

In use, the envelope 12 (FIGS. 1–3) or 51 (FIG. 4) is filled with a fluid such as air or water. This material serves as a cushioning agent for the foot of the wearer. The valve stem 18 provides a facile means for providing a toe grip for the sandal arrangement. It will, of course, be understood by those skilled in the art that other toe grip arrangements may likewise be provided, each toe grip section adapted to extend between adjacent toes of the same foot, and each toe grip providing means for inflating a separate portion of the podiatric device. In such an arrangement, the envelope could be divided into discrete sections, each of which is capable of being separately inflated.

The bead and slot arrangement shown and described above provides a facile mechanism for allowing the envelope to be removed from this shell supporting that envelope, in the event a replacement envelope is required.

I claim:

1. An inflatable podiatric device comprising:
a sole including an inflatable envelope formed of a flexible material having a first surface adapted to conform to a foot of a wearer thereof;
means extending through said envelope along said first surface for inflating said envelope; and wherein
said inflating means extends substantially above said first surface whereby said inflating means is engagable between adjacent toes of said wearer.

2. A podiatric device as recited in claim 1 further comprising strap means coupled with said sole and adapted to extend across the top of said wearer's foot.

3. A podiatric device as recited in claim 2 wherein said strap means is coupled to said inflating means.

4. A podiatric device as recited in claim 3 wherein said strap means includes a first strap portion extending between a first side of said sole to said inflating means, and a second strap portion extending between a second side of said sole to said inflating means.

5. A podiatric device as recited in claim 4 wherein said inflating means includes a valve stem having a threaded extremity.

6. The podiatric device as recited in claim 5 further comprising:
a closure member adapted to engage said threaded extremity of said valve stem; and wherein
said strap means includes a hole between said first and second strap portions, said hole being dimensioned such that said strap means fits about said valve stem and is restricted when said closure member is engaged in said valve stem.

7. A podiatric device as recited in claim 6 wherein said sole further includes a shell of a relatively inflexible material with respect to said envelope, said shell including a cavity therein for receiving said envelope.

8. A podiatric device as recited in claim 7 further comprising means for locking said envelope in said cavity.

9. A podiatric device as recited in claim 8 wherein said locking means comprises:
one of said envelope and said shell having a bead about the periphery thereof, the other of said envelope and said shell having a peripheral slot adapted to receive said bead; and wherein
pressing of said envelope into said cavity causes said bead to lock in said slot.

10. A podiatric device as recited in claim 9 wherein said sole further includes a layer of relatively rigid material with respect to said envelope and said shell, said shell interposed between said flexible envelope and said rigid layer.

11. An inflatable podiatric device comprising:
a sole including an envelope formed of a flexible material having a first surface adapted to conform to a foot of a wearer thereof;
said sole further including a shell of a relatively inflexible material with respect to said envelope, said shell including a cavity therein for receiving said envelope;
means for locking said envelope in said cavity;
means for extending through said envelope along said first surface for inflating said envelope; and wherein
said inflating means extends substantially above said first surface whereby said inflating means is engagable between adjacent toes of said wearer.

12. A podiatric device as recited in claim 11 wherein said locking means comprises:
one of said envelope and said shell having a bead about the periphery thereof, the other of said envelope and said shell having a peripheral slot adapted to receive said bead; and wherein
pressing of said envelope into said cavity causes said bead to lock into said slot.

13. A podiatric device as recited in claim 11 further comprising strap means coupled with said sole and adapted to extend across the top of said wearer's foot.

14. An inflatable podiatric device comprising:
a sole including an inflatable envelope formed of a flexible material having a first surface adapted to conform to a foot of the wearer thereof;
a valve stem having a threaded extremity extending through said envelope along said first surface for inflating said envelope;
a closure member adapted to engage said threaded extremity of said valve stem; and wherein
said valve stem extends substantially above said first surface whereby said inflating means is engagable between adjacent toes of said wearer.

15. A podiatric device as recited in claim 14 further comprising strap means coupled with said sole and adapted to extend across the top of said wearer's foot.

16. A podiatric device as recited in claim 15 wherein said strap means includes a hole therein, said hole dimension such that said strap means fits about said valve stem and is restricted in movement when said closure member is engaged in said valve stem.

17. An inflatable podiatric device comprising:
a sole including an envelope formed of a flexible material having a first surface adapted to conform to a foot of a wearer thereof;
said sole further including a shell of a relatively inflexible material with respect to said envelope, said shell including a cavity therein for receiving said envelope;
means extending through said envelope for inflating said envelope;
a stem carried by, and extending above said envelope and engagable between adjacent toes of said wearer; and
strap means coupled with said sole and said stem and adapted to extend across the top of said wearer's foot.

* * * * *